United States Patent [19]

Smith et al.

[11] 4,154,130

[45] May 15, 1979

[54] CUTTING PRESS WITH STROKE TERMINATING MEANS

[75] Inventors: Peter S. Smith; Roger J. Benney, both of Bristol, England

[73] Assignee: USM Corporation, Farmington, Conn.

[21] Appl. No.: 882,457

[22] Filed: Mar. 1, 1978

[30] Foreign Application Priority Data

Jun. 2, 1977 [GB] United Kingdom ..... 23539/77

[51] Int. Cl.[2] ..... B26D 5/12; B26D 7/26

[52] U.S. Cl. ..... 83/525; 83/530; 83/533; 100/257

[58] Field of Search ..... 85/525, 530, 533, 541, 85/529; 100/257

[56] References Cited

U.S. PATENT DOCUMENTS

| | | | |
|---|---|---|---|
| 3,241,416 | 3/1966 | Jacobsen | 83/530 X |
| 3,280,685 | 10/1966 | Derrah et al. | 83/529 X |
| 3,543,628 | 12/1970 | Chiesa | 83/525 |

*Primary Examiner*—J. M. Meister

*Attorney, Agent, or Firm*—Carl E. Johnson; Vincent A. White; Richard B. Megley

[57] ABSTRACT

In a cutting press of the type wherein an upper platen is forced toward a lower platen to press a die through a workpiece on the lower platen, a more easily operable stroke setting means is provided. In the course of low pressure actuation of the upper platen for this purpose, an operator need only deactivate a solenoid whereby a brake becomes effective to establish the cutting stroke as appropriate to the depth of a die, for subsequent high pressure cutting strokes of the press.

8 Claims, 4 Drawing Figures

CUTTING PRESS WITH STROKE TERMINATING MEANS

BACKGROUND OF THE INVENTION

This invention is concerned with improvements in or relating to cutting presses.

Cutting presses which comprise an upper platen, a lower platen, and hydraulic piston and cylinder means for moving the upper platen so that the upper platen approaches the lower platen whereby to effect a cutting stroke of the press are well known. An example of such a press is described, for instance, in British patent specification No. 1,035,816. In the operation of such a press, a workpiece is placed on the lower platen and a shaped knife or die is placed on top of the workpiece. The hydraulic piston and cylinder means is then operated so that the upper platen presses the knife or die through the workpiece. The upper platen may be supported above the lower platen on one, two or four columns.

A cutting press is described in British patent specification No. 1,342,585 published Jan. 3, 1974, which comprises an upper platen supported on one column above a lower platen thereof, means for effecting relative movement of approach between the platens whereby to effect a cutting stroke of the press, and stroke control means. The stroke control means comprises stroke terminating means effective to terminate a cutting stroke of the press and stroke setting means for setting the distance of a cutting stroke according to the depth of the cutting die in use. The stroke terminating means comprises a switch and an actuator therefor which is moved as the platens move together, and the stroke setting means is arranged to position the switch at a stroke-terminating position. The stroke setting means comprises a carriage on which the switch is mounted and brake means for holding the carriage against movement on a slideway therefor. The brake means requires an operator to pull the brake means into an off position and maintain it there so that a stroke setting operation of the press may be made to position the switch. In some circumstances, this form of brake means is difficult to operate.

SUMMARY OF THE INVENTION

It accordingly is an object of the present invention to provide an improved cutting press having stroke setting means which is more convenient to operate.

There is hereinafter described a cutting press which is illustrative of the invention. The illustrative press comprises an upper platen, a lower platen, means for moving the upper platen so that the upper platen approaches the lower platen whereby to effect a cutting stroke of the press, stroke terminating means and, notably, improved stroke setting means.

The stroke terminating means of the illustrative press comprises an actuator member which projects from a rod connected to the upper platen. Movement of the upper platen causes movement of the rod and thus the actuator member is moved in a vertical path. The stroke terminating means also comprises a microswitch mounted in the path of the actuator member to be operated thereby. Operation of the microswitch is effective to terminating a cutting stroke of the press.

The stroke setting means of the illustrative press is for bringing the microswitch of the stroke terminating means to a stroke-terminating position. The stroke setting means comprises a carriage mounted for vertical movement on a slideway adjacent to the path of the actuator member. The microswitch of the stroke terminating means is mounted on the carriage. The stroke setting means also comprises brake means in the form of a lever which is movable between an operative condition in which it holds the carriage against movement on the slideway and an inoperative condition, and moving means in the form of a tension or clock spring which urges the carriage upwards on the slideway.

The stroke setting means of the illustrative press also comprises an abutment member mounted on the carriage for movement between an operative position thereof in which it projects into the path of the actuator member and an inoperative position thereof, and operating means in the form of a solenoid arranged, when energized, to move the brake means into its inoperative condition and the abutment member into its operative position.

The present invention provides a cutting press comprising an upper platen, a lower platen, means for moving the upper platen so that the upper platen approaches the lower platen whereby to effect a cutting stroke of the press, stroke terminating means comprising an actuator member mounted for movement in a vertical path and interconnected with the upper platen so that movement of the upper platen brings about corresponding movement of the actuator member, and a switch mounted in the path of the actuator to be operated thereby, operation of the switch being effective to terminate a cutting stroke of the press, and stroke setting means for bringing the switch of the stroke terminating means to a stroke-terminating position appropriate to a cutting die to be used for subsequent cutting operations, the stroke setting means comprising a carriage mounted for vertical movement on a slideway adjacent to the path of the actuator member, the switch of the stroke terminating means being mounted on the carriage, brake means movable between an operative condition in which it holds the carriage against movement on its slideway and an inoperative condition in which it allows the carriage to move on its slideway, moving means arranged to urge the carriage upwards on its slideway, an abutment member mounted on the carriage for movement between an operative position thereof in which it projects into the path of the actuator member and an inoperative position thereof, and operating means activatable to move the brake means into its inoperative condition and the abutment member into its operative position. The construction accordingly is such that, in carrying out a stroke setting operation of the press, with a cutting die to be used for subsequent cutting operations interposed between the platens, the switch of the stroke terminating means can be rendered ineffective and the operating means operated, thereby moving the brake means to its inoperative condition so that the moving means moves the carriage upwards until the abutment member engages the actuator member, and upon the upper platen being moved into engagement with the cutting die, the actuator member, engaging the abutment member, causes the carriage to be moved downwards on its slideway to a stroke-terminating position whereupon de-activation of the operating means causes the brake means to move into its operative position. Hence, upon upward movement of the upper platen, the actuator member is set apart from the switch by a distance corresponding to a cutting stroke of the press.

DESCRIPTION OF THE DRAWINGS

It is to be understood that the illustrative cutting press has been selected for description by way of example and not of limitation of the invention.

In the accompanying drawings.

DESCRIPTION OF THE PREFERRED EMBODIMENT

Figure 1:
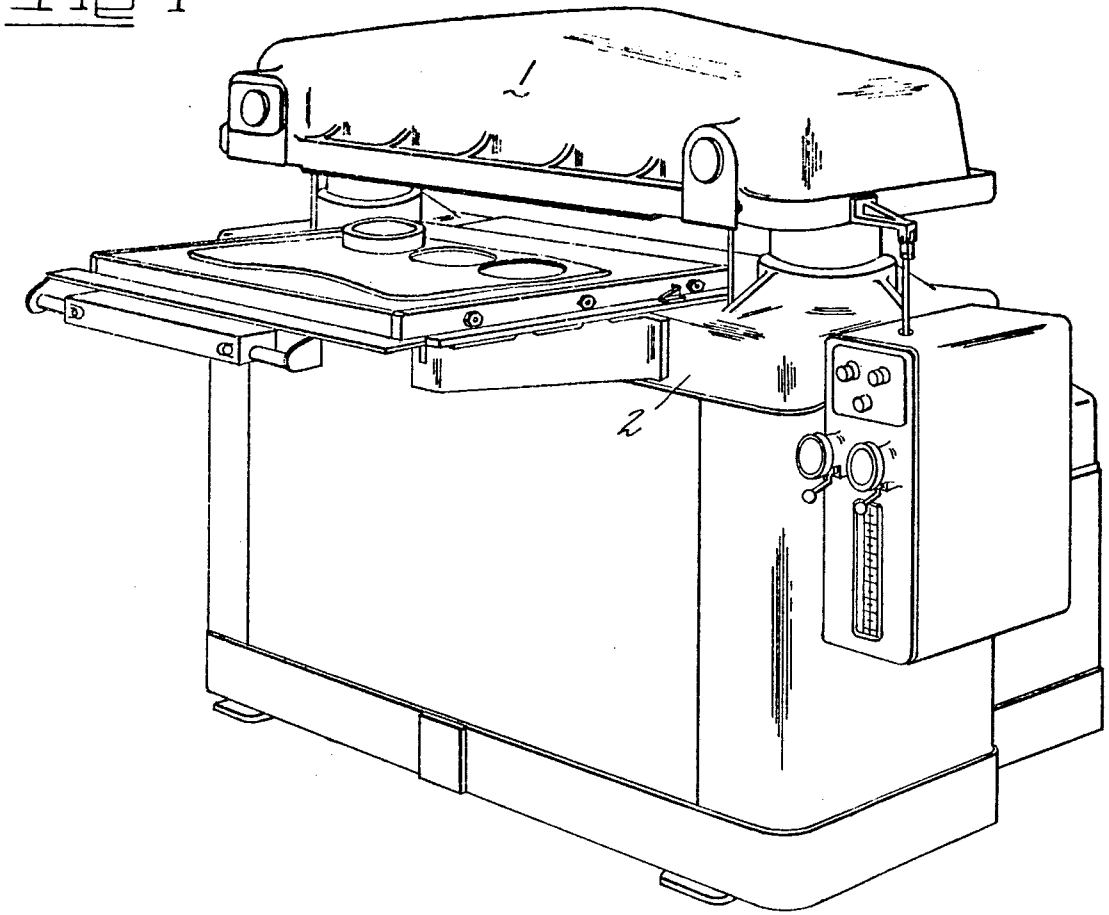
FIG. 1 is a perspective view of an illustrative press which may be of the type disclosed in British patent specification No. 1,035,816.

The illustrative cutting press generally resembles that described in British patent specification No. 1,035,816 and in appearance, may be similar to that shown in U.S. Pat. No. Des. 198,995, in that it comprises a framework which supports two columns, an upper platen 1 supported on the two columns, a lower platen 2 below the upper platen, and hydraulic piston and cylinder means (not herein shown) for moving the upper platen by moving the columns so that the upper platen approaches the lower platen whereby to effect a cutting stroke of the press. The hydraulic piston and cylinder means is operable at high pressure to effect a cutting stroke of the press or at low pressure to effect a setting operation of the press. The press also comprises stroke terminating means and stroke setting means hereinafter to be described.

The stroke terminating means comprises a rod 4 (FIGS. 2 and 4) which depends from a portion of the upper platen 1 which projects beyond the lower platen 2. The rod 4 has an actuator member 6 (FIGS. 3, 4) projecting normally therefrom. The actuator member 6 is thus interconnected with the upper platen so that, when the upper platen is moved, the actuator member 6 is moved in a vertical path by a corresponding amount. The actuator member 6, for a purpose later mentioned, has a groove 8 in the undersurface thereof.

The stroke terminating means also comprises a microswitch 10 (FIGS. 2 and 3, and indicated by chain dot in FIG. 4) which has an actuator roll 12 which is mounted in the path of the actuator member 6 (see FIG. 3) so that the microswitch 10 can be operated thereby. Operation of the microswitch 10 is effective to terminate a cutting stroke of the press by reversing the direction of operation of the aforementioned hydraulic piston and cylinder means.

Figure 2:
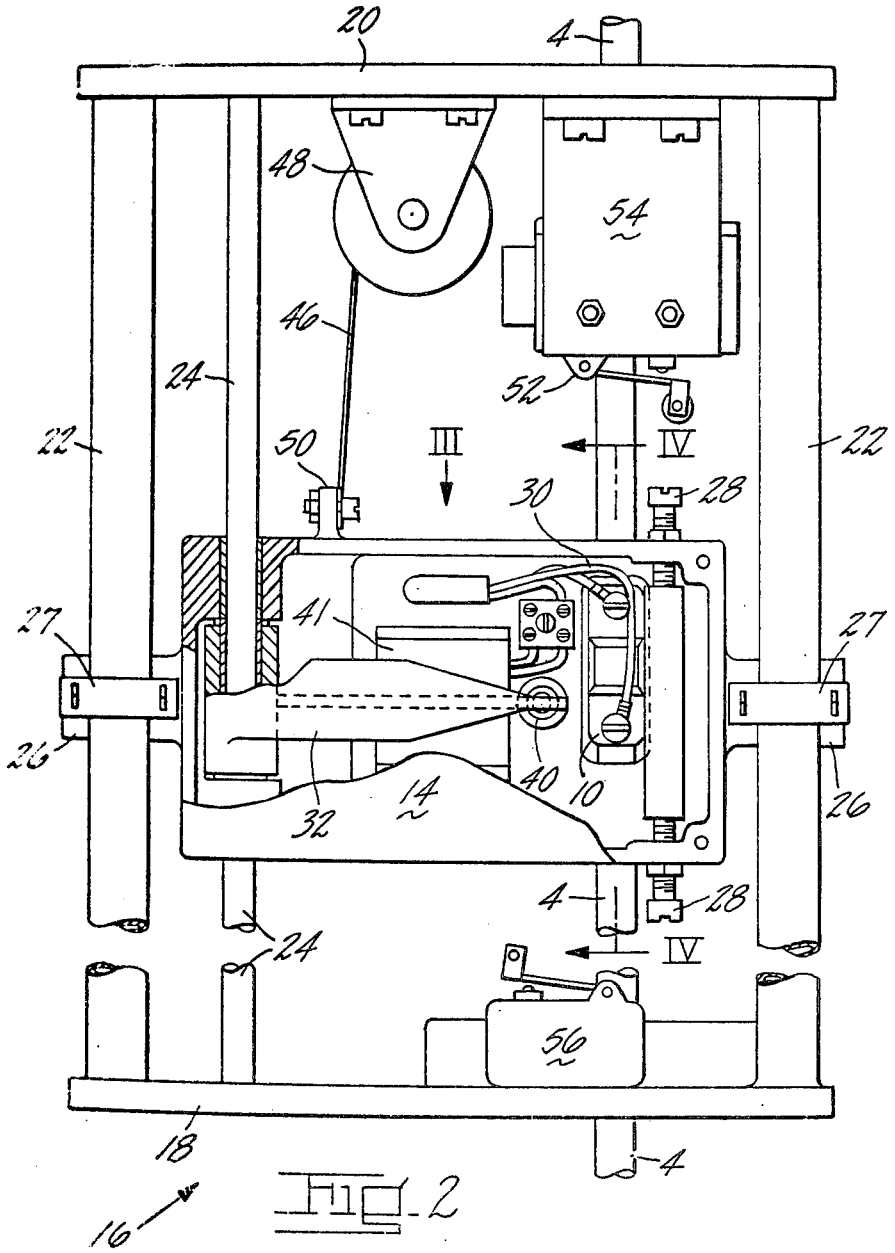
FIG. 2 is a side elevational view of stroke setting means of the illustrative cutting press.

The stroke setting means of the illustrative press is arranged to bring the microswitch 10 to a stroke-terminating position appropriate to a cutting die to be used for subsequent cutting operations. The stroke setting means comprises a carriage 14 which is mounted for vertical movement on a slideway generally designated 16 (FIG. 2) adjacent to the path of the actuator member 6. The slideway 16 is mounted on the framework of the press and comprises a base plate 18, a top plate 20, two vertically-extending tubes 22 interconnecting the plates 18 and 20, and a vertically-extending rod 24 also interconnecting the plates 18 and 20. The carriage 14 has two projecting extensions 26 which are respectively secured to the tubes 22 by means of plates 27 held on the extensions 26 by screws 29. The extensions 26 allow the carriage to slide heightwise relative to the tubes 22. The rod 24 extends through the carriage 14. The microswitch 10 of the stroke terminating means is mounted on the carriage 14 and its height on the carriage 14 can be adjusted by means of set screws 28. FIG. 2 also shows electrical connections 30 to the microswitch 10.

Figure 3:
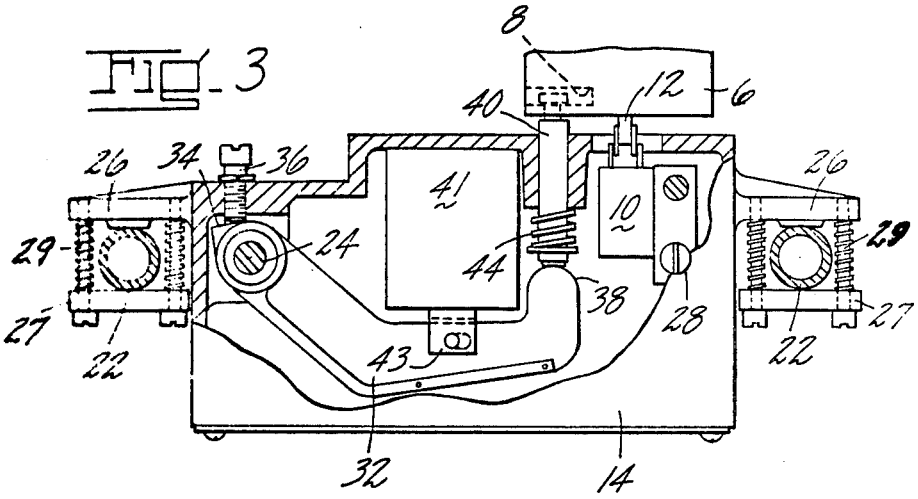
FIG. 3 is a view, partly in section, taken in the direction of the arrow II in FIG. 2.
Figure 4:
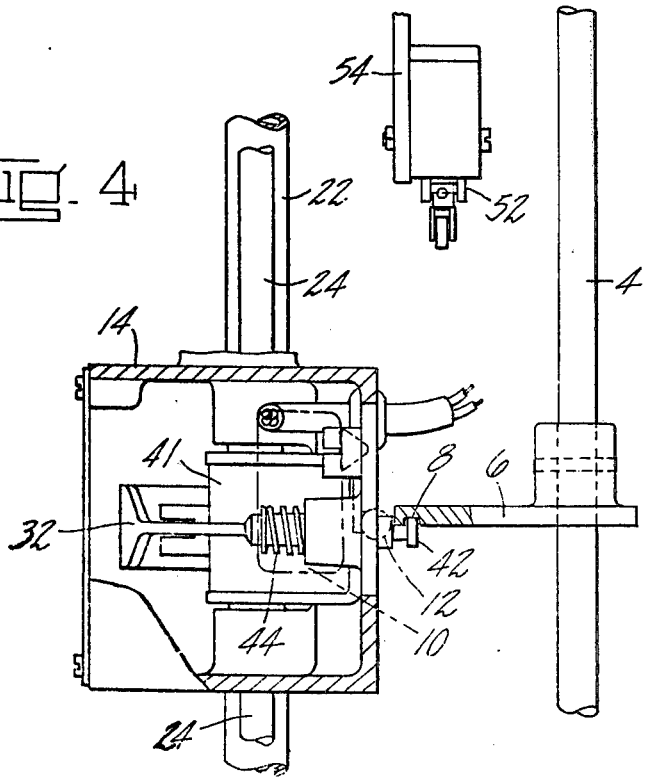
FIG. 4 is a sectional view taken along the line IV—IV in FIG. 2.

The stroke setting means also comprises brake means next to be explained, movable between an operative condition in which it holds the carriage 14 against movement on the slideway 16 and an inoperative condition in which it allows the carriage 14 to move on the slideway 18. The brake means comprises a lever 32 (FIGS. 2–4) pivotally mounted within the carriage 14 on the rod 24 and having a wedging surface 34 (FIG. 3) adapted to engage a stop screw 36 of the carriage 14. The lever 32 is movable between a first braking position in which the surface 34 bears against the screw 36 and consequently binds on the rod 24 thus to lock the carriage 14 on the slideway, and a second free position as shown in FIG. 3 in which the member 32 has moved counterclockwise from its first position and an abutment face 38 engages an abutment member 40 moving it into an operative position thereof.

A solenoid 41 is mounted on the carriage 14 and has a core 43 which is pivotally connected to the leber 32. The arrangement is such that, when the solenoid is energized, it moves the lever 32 to its second position thus bringing the brake means to its inoperative condition. The solenoid 41, thus constitutes operating means activatable to move the brake means into its inoperative condition and the abutment member 40 into its operative position.

The abutment member 40 is mounted on the carriage 14 for longitudinal sliding movement between the operative position thereof (shown in FIG. 3) in which it projects into the path of the actuator member 6 and an inoperative position thereof in which the actuator member 6 can pass it without engaging it. The abutment member 40 is recessed so that it has a head portion 42 which can fit into the above-mentioned groove 8 of the actuator member 6. When the head position 42 is in the groove 8, the abutment member 40 is thereby prevented from returning to its inoperative position. The actuator member 6 and the abutment member 40 are thus constructed so that, while the actuator member 6 and the abutment member 40 are in engagement, the members 6 and 40 interlock to prevent movement of the abutment member 40 out of its operative position. The abutment member 40 is urged by a coil spring 44 towards its inoperative position. The spring 44 is effective, when the abutment member 40 is in engagement with the surface 38 of the leber 32 to urge the lever 32 into its first or braking position.

The stroke setting means of the illustrative press also comprises moving means in the form of a partly coiled tension or clock spring 46. The spring 46 is suspended from a bracket 48 which depends from the plate 20 and is connected to an upward projection 50 of the carriage 14. The spring 46 is thus arranged to urge the carriage 14 upwards on the slideway 16.

The illustrative cutting press also comprises at the upper end of the slideway 16 a microswitch 52 (FIGS. 2, 4) mounted on a bracket 54 which depends from the plate 20. The microswitch 52 is effective, when engaged by the actuator member 6, to prevent operation of the hydraulic piston and cylnder means for moving the upper platen 1 away from the lower platen 2. Thus the actuated microswitch 52 serves to prevent the hydraulic piston and cylinder means from attempting to raise the upper platen 1 excessively.

The illustrative cutting press also comprises a microswitch 56 mounted on the plate 18 and effective, when engaged by descent of the carriage 14, to prevent operation of the hydraulic piston and cylinder means. The microswitch 56 thus serves to prevent operation of the illustrative press if the spring 46 fails and the carriage 14 falls to the bottom of the slideway 16.

In the operation of the illustrative cutting press, a workpiece is positioned on the lower platen 2 with a cutting die CD (FIG. 1) on top of the workpiece and the hydraulic piston and cylinder means operates to effect a cutting stroke by moving the upper platen 1 downwards. As the upper platen moves, the actuator member 6 moves downwards until it engages the microswitch 10 whereupon the operation of the hydraulic piston and cylinder means is reversed. However, before operating the press as aforesaid, a stroke setting operation must be carried out to correctly position the microswitch 10 heightwise relative to the actuator member 6.

In carrying out a stroke setting operation of the illustrative press, with a particular cutting die CD to be used for subsequent cutting operations interposed between the platens but without a workpiece between the platens, an operator of the press closes an electric circuit (not herein shown in detail) which energizes the solenoid 41. Energization of the solenoid 41 is also effective to render the microswitch 10 ineffective since a relay in the circuit to the solenoid 41 opens a contact in the circuit to the microswitch 10. Energization of the solenoid 41 causes the lever 32 to be moved to its second position (FIG. 3) in which the brake means is in its inoperative condition and the abutment member 40 is in the path of the actuator member 6. Since the brake means is not holding the carriage 14 against movement, the spring 46 causes the carriage 14 to move to the top of the slideway 16 where it is brought to rest by engagement between the abutment member 40 and the actuator member 6. The head portion 42 enters the groove 8 holding the abutment member 40 in its operative position so that there is no possibility that downwards movement of the actuator member 6 will cause the actuator member 6 to push the abutment member 40 out of the way thus disengaging the actuator member 6 from the abutment member 40.

The operator of the illustrative press next causes the hydraulic piston and cylinder means to operate under low pressure to move the upper platen 1 downwards. As the upper platen moves downwards, the carriage 14 is also carried downwards on the slideway 16 because of the engagement between the actuator member 6 and the abutment member 40. When the upper platen engages the cutting die CD whereupon the carriage 14 is at a stroke-terminating position thereof, the operator deactivates the solenoid 41 causing the brake means to move into its operative position so that the carriage 14 is no held against movement on the slideway 16. The operation of the hydraulic piston and cylinder means is now reversed and, upon upwards movement of the upper platen, the actuator member 6 is set apart from the microswitch 10 by a distance corresponding to a cutting stroke of the press.

It is found that the stroke setting means of the illustrative cutting press is easy to operate since the operator is only required to operate an electrical switch to energize and de-energize the solenoid 41.

Having thus described our invention what we claim as new and desire to secure as Letters Patent of the United States is:

1. A cutting press comprising an upper platen, a lower platen, means for moving the upper platen so that the upper platen approaches the lower platen whereby to effect a cutting stroke of the press, stroke terminating means comprising an actuator member mounted for movement in a vertical path and interconnected with the upper platen for movement therewith, and a switch mounted in the path of the actuator member to be operated thereby, operation of the switch being effective to terminate a cutting stroke of the press, and stroke setting means for bringing the switch of the stroke terminating means to a stroke-terminating position appropriate to a cutting die to be used for subsequent cutting operations, the stroke setting means comprising a carriage mounted for vertical movement on a slideway adjacent to the path of the actuator member, the switch of the stroke terminating means being mounted on the carriage, brake means movable between an operative condition in which it holds the carriage against movement on its slideway and an inoperative condition in which it allows the carriage to move on its slideway, moving means arranged to urge the carriage upwards on its slideway, an abutment member mounted on the carriage for movement between an operative position thereof in which it projects into the path of the actuator member and an inoperative position thereof, and operating means activatable to move the brake means into its inoperative condition and the abutment member into its operative position, the construction and arrangement being such that, in carrying out a stroke setting operation of the press, with a cutting die to be used for subsequent cutting operations interposed between the platens, the switch of the stroke terminating means can be rendered ineffective and the operating means operated, thereby moving the brake means to its inoperative condition so that the moving means moves the carriage upwards until the abutment member engages the actuator member, and upon the upper platen being moved into engagement with the cutting die, the actuator member, engaging the abutment member, causes the carriage to be moved downwards on its slideway to a stroke-terminating position whereupon de-activation of the operating means causes the brake means to move into its operative position so that, upon upwards movement of the upper platen, the actuator member is set apart from the switch by a distance corresponding to a cutting stroke of the press.

2. A cutting press according to claim 1 wherein the actuator member and the abutment member are constructed so that, while the actuator member and the abutment member are in engagement, the members interlock so that movement of the abutment member out of its operative position is prevented.

3. A cutting press according to claim 1 wherein the brake means comprises a lever pivotally mounted on a vertically-extending rod of the slideway for movement between a first position in which the lever bears on the rod preventing movement of the carriage and a second position in which the carriage is free to move and the levers holds the abutment member in its operative position.

4. A cutting press according to claim 3 wherein the abutment member is urged by spring means towards its inoperative position, the spring means also being effective to urge the lever into its first position.

5. A cutting press according to claim 3 wherein the brake means also comprises a solenoid effective, when energized, to move the lever to its second position thus bringing the brake means to its inoperative condition.

6. A cutting press according to claim 5 wherein the arrangement is such that energization of the solenoid is effective to render the switch of the stroke control means ineffective.

7. A cutting press according to claim 3 wherein the press also comprises switch means mounted at an upper end of the slideway and effective, when engaged by the actuator member, to prevent operation of the means for moving the upper platen to move the upper platen away from the lower platen.

8. A cutting platen according to claim 5 wherein the press comprises switch means mounted at a lower end of the slideway and effective, when engaged by the carriage, to prevent operation of the means for moving the upper platen.

* * * * *